US012808142B2

(12) United States Patent
Frey et al.

(10) Patent No.: US 12,808,142 B2
(45) Date of Patent: Nov. 24, 2026

(54) EXCAVATOR ATTACHMENT WITH A WORKING TOOL

(71) Applicant: AMI Attachments Inc., Hawkesville (CA)

(72) Inventors: Steven Oscar Frey, Elmira (CA); Dwight Colin Myer, Moorefiled (CA)

(73) Assignee: AMI Attachments Inc., Hawkesville (CA)

( * ) Notice: Subject to any disclaimer, the term of this patent is extended or adjusted under 35 U.S.C. 154(b) by 252 days.

(21) Appl. No.: 18/842,971

(22) PCT Filed: Mar. 3, 2023

(86) PCT No.: PCT/CA2023/050284
§ 371 (c)(1),
(2) Date: Aug. 30, 2024

(87) PCT Pub. No.: WO2023/164779
PCT Pub. Date: Sep. 7, 2023

(65) Prior Publication Data

US 2025/0198114 A1 Jun. 19, 2025

Related U.S. Application Data

(60) Provisional application No. 63/316,133, filed on Mar. 3, 2022.

(51) Int. Cl.
*E02F 3/40* (2006.01)
*E02F 3/36* (2006.01)

(52) U.S. Cl.
CPC ..... *E02F 3/404* (2013.01)

(58) Field of Classification Search
CPC ..... E02F 3/404; E02F 3/4135; E02F 3/413; E02F 3/407; E02F 3/40; E02F 3/3686; E02F 3/365; E02F 3/3645; E02F 3/364
See application file for complete search history.

(56) References Cited

U.S. PATENT DOCUMENTS 7,000,339 B1 2/2006 Ramun
7,617,619 B2 11/2009 Cox
(Continued)

FOREIGN PATENT DOCUMENTS

JP S61 68935 A 4/1986
JP H03 89758 U 9/1991
(Continued)

OTHER PUBLICATIONS

European Patent Office, Extended European Search Report dated Jan. 29, 2026, issued to European Patent Application No. 23762650.2.
(Continued)

*Primary Examiner* — Robert E Pezzuto
(74) *Attorney, Agent, or Firm* — Smart & Biggar LP

(57) ABSTRACT

An excavator attachment assembly is described herein. The assembly includes a attachment having first and second side walls, a top wall and a rear wall co-operating to define a cavity of the attachment, an excavator coupler and a working tool. The attachment includes at least one coupling assembly for rotatably coupling the working tool to the attachment. The coupling assembly includes a drive shaft configured to rotate relative to outside and inside flanges of the coupling assembly, a cylinder lug fixedly coupled to the drive shaft and a linear actuator fixedly mounted to the top wall and coupled to the cylinder lug. The linear actuator is configured to rotate the drive shaft when actuated between a retracted position and an extended position. The connecting arm of the working tool is secured to the drive shaft so that the working tool rotates upon rotation of the drive shaft by the actuator.

20 Claims, 17 Drawing Sheets

(56) References Cited

U.S. PATENT DOCUMENTS

| | | | | |
|---|---|---|---|---|
| 10,774,498 | B2 * | 9/2020 | Frey | E02F 3/365 |
| 2008/0282585 | A1 | 11/2008 | Cox | |
| 2010/0254755 | A1 | 10/2010 | Luyendijk et al. | |
| 2011/0283571 | A1 * | 11/2011 | Vuistiner | B66C 3/02 37/444 |
| 2019/0032301 | A1 * | 1/2019 | Breu | E02F 3/3663 |
| 2019/0100896 | A1 | 4/2019 | Frey et al. | |
| 2020/0407938 | A1 | 12/2020 | Frey et al. | |

FOREIGN PATENT DOCUMENTS

| | | | |
|---|---|---|---|
| JP | 2 920397 | B2 | 7/1999 |
| WO | 2012010921 | A1 | 1/2012 |
| WO | 2017161458 | A1 | 9/2017 |

OTHER PUBLICATIONS

Canadian Intellectual Property Office, International Searching Authority, The International Search Report and the Written Opinion of the International Searching Authority, dated May 18, 2023.

* cited by examiner

EXCAVATOR ATTACHMENT WITH A WORKING TOOL

CROSS-REFERENCE

This application claims the benefit of U.S. Provisional Patent Application No. 63/316,133, filed Mar. 3, 2022, the entire contents of which are incorporated by reference herein for all purposes.

TECHNICAL FIELD

This disclosure relates generally to excavator attachments, and more specifically, to excavator attachments with a working tool.

BACKGROUND

Excavators are commonly used by builders and contractors to move large amounts of earth, rocks and other materials. Excavators commonly include a boom or arm that extends from a main body of the machine and an attachment pivotally attached to the end of the arm.

There are many different excavator attachments for different uses. Excavator attachments with an integrated working tool, or thumb, can makes it easier to pick, hold and move awkward material such as rocks, concrete, branches, and debris that does not fit into the bucket. When moving these awkward materials, it can be important for the working tool to have an adequate holding strength to maintain a constant grip on the material throughout the attachment's entire rotation.

Current excavator attachments with an integrated working tool can be hydraulically powered, however, in these cases, the hydraulic actuator is typically mounted to the boom of the excavator. This can lead to downtime for the machine when the operator wants to switch to another bucket. Other non-hydraulic designs are also available, however, they lack the holding strength offered by hydraulic systems.

Accordingly, there is a need for improved excavator attachments with hydraulic working tools.

SUMMARY

In accordance with a broad aspect, an excavator attachment assembly is described herein. The assembly includes an attachment comprising first and second side walls spaced apart from each other, a top wall coupled to the first and second side walls and a rear wall coupled to the first and second side walls, the first and second sides walls, the top wall and the rear wall defining a cavity of the attachment; an excavator coupler extending upwardly from the top wall of the attachment for coupling the attachment to an arm of the excavator; and a working tool having at least one connecting arm. The attachment comprises at least one coupling assembly fixed to the top wall of the attachment on a side of the excavator coupler for coupling the working tool to the attachment. The coupling assembly includes an outside flange and an inside flange spaced apart from each other, each flange extending upwardly from the top wall of the attachment; a drive shaft extending laterally between the outside flange and the inside flange, the drive shaft being configured to rotate relative to the outside and inside flanges; a cylinder lug fixedly coupled to the drive shaft in a space between the outside flange and the inside flange; and a linear actuator positioned between the inside flange and the outside flange, below a top edge of the inside flange and below a top edge of the outside flange, the linear actuator having a first end mounted to the top wall and a second end coupled to the cylinder lug, the linear actuator being configured to rotate the drive shaft upon being actuated between a retracted position and an extended position. The connecting arm of the working tool is coupled to an outside end of the drive shaft, whereby the working tool rotates between an open position and a closed position upon rotation of the drive shaft.

In at least one embodiment, the drive shaft includes an inside splined portion and the cylinder lug is coupled to the drive shaft at the inside splined portion.

In at least one embodiment, the inside splined portion is positioned between the inside flange and the outside flange.

In at least one embodiment, the inside splined portion has a diameter that is less than a diameter of an aperture of the outside flange to be inserted through the outside flange.

In at least one embodiment, the cylinder lug comprises a mating portion configured to mate with the inside splined portion to receive a torque from the linear actuator and rotate the drive shaft.

In at least one embodiment, the drive shaft includes an outside splined portion and the connecting arm is coupled to the drive shaft at the outside splined portion.

In at least one embodiment, the outside splined portion extends outwardly from the outside coupling flange.

In at least one embodiment, the outside splined portion has a diameter that is greater than a diameter of an aperture of the outside coupling flange to inhibit the outside splined portion from being inserted through the outside coupling flange.

In at least one embodiment, the inside splined portion has a first diameter and the outside splined portion has a second diameter, the first diameter and the second diameter being different.

In at least one embodiment, the first diameter is less than the second diameter.

In at least one embodiment, the coupling assembly further comprises a lid, the lid, the outside flange and the inside flange co-operating to form a housing of the excavator attachment assembly.

In at least one embodiment, the linear actuator is positioned within a compartment defined by the housing.

In at least one embodiment, the drive shaft is at least partially positioned within the compartment.

In at least one embodiment, the attachment is a bucket.

In at least one embodiment, the attachment is a rake.

In at least one embodiment, the working tool is a thumb.

In at least one embodiment, the working tool is a jaw bone.

In at least one embodiment, the working tool is a single working arm.

In accordance with another broad aspect, an excavator attachment assembly is described. The assembly includes an attachment comprising first and second side walls spaced apart from each other, a top wall coupled to the first and second side walls and a rear wall coupled to the first and second side walls, the first and second sides walls, the top wall and the rear wall defining a cavity of the attachment, an excavator coupler extending upwardly from the top wall of the attachment for coupling the attachment to an arm of the excavator; and a working tool having two spaced apart connecting arms. The attachment comprises two coupling assemblies fixed to the top wall of the attachment, the two coupling assemblies being positioned on opposed sides of the excavator coupler for coupling the working tool to the attachment. Each coupling assembly includes an outside flange and an inside flange extending upwardly from the top wall of the attachment, the inside flange being spaced from the outside flange; a drive shaft extending laterally between the outside flange and the inside flange, the drive shaft being configured to rotate relative to the outside and inside flanges; a cylinder lug fixedly coupled to the drive shaft in a space between the outside flange and the inside flange; and a linear actuator positioned between the inside flange and the outside flange and below a top edge of the inside flange and below a top edge of the outside flange, the linear actuator having a first end mounted to the top wall and a second end coupled to the cylinder lug, the linear actuator being configured to rotate the drive shaft upon being actuated between a retracted position and an extended position. Each connecting arm of the working tool is fixedly secured to an outside end of one of the drive shafts, whereby the working tool rotates between an open position and a closed position upon rotation of each of the drive shafts.

In accordance with a broad aspect, an excavator attachment assembly is described herein. The assembly includes an attachment comprising first and second side walls spaced apart from each other, a top wall coupled to the first and second side walls and a rear wall coupled to the first and second side walls, the first and second sides walls, the top wall and the rear wall defining a cavity of the attachment; an excavator coupler extending upwardly from the top wall of the attachment for coupling the attachment to an arm of the excavator; and a working tool having at least one connecting arm. The attachment comprises at least one coupling assembly fixed to the top wall of the attachment for coupling the working tool to the attachment. The coupling assembly includes an outside flange and an inside flange spaced apart from each other, each flange extending upwardly from the top wall of the attachment; a drive shaft extending laterally between the outside flange and the inside flange, the drive shaft being configured to rotate relative to the outside and inside flanges; a cylinder lug fixedly coupled to the drive shaft in a space between the outside flange and the inside flange; and a linear actuator positioned between the inside flange and the outside flange, below a top edge of the inside flange and below a top edge of the outside flange, the linear actuator having a first end mounted to the top wall and a second end coupled to the cylinder lug, the linear actuator being configured to rotate the drive shaft upon being actuated between a retracted position and an extended position. The connecting arm of the working tool is coupled to an outside end of the drive shaft, whereby the working tool rotates between an open position and a closed position upon rotation of the drive shaft.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
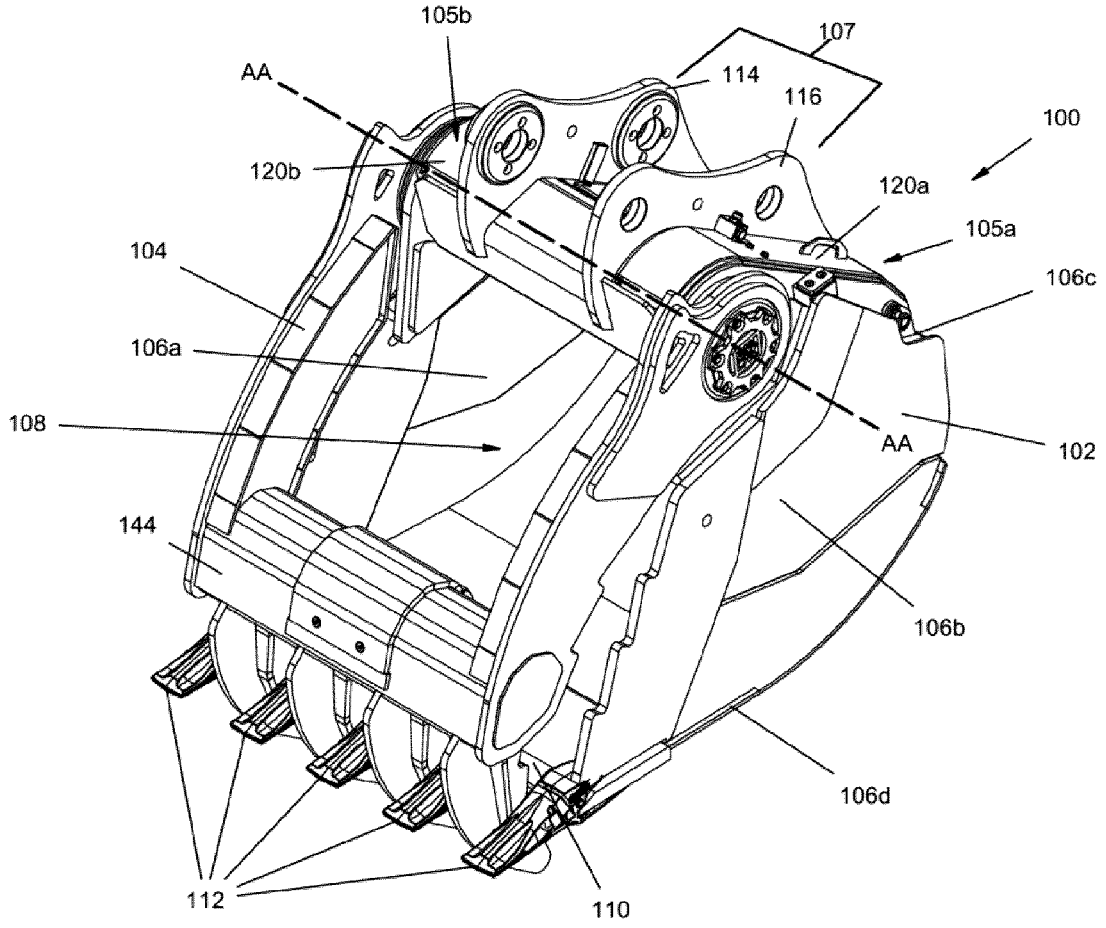
FIG. 1 is a front perspective view from above of an excavator attachment assembly having an excavator bucket and a working tool coupled thereto, according to at least one embodiment described herein.

Further aspects and features of the example embodiments described herein will appear from the following description taken together with the accompanying drawings.

DETAILED DESCRIPTION

Various apparatuses, methods and compositions are described below to provide an example of at least one embodiment of the claimed subject matter. No embodiment described below limits any claimed subject matter and any claimed subject matter may cover apparatuses and methods that differ from those described below. The claimed subject matter are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed subject matter. Any subject matter that is disclosed in an apparatus, method or composition described herein that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the end result is not significantly changed. These terms of degree should be construed as including a deviation of the modified term, such as 1%, 2%, 5%, or 10%, for example, if this deviation does not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

It should also be noted that, as used herein, the wording "and/or" is intended to represent an inclusive—or. That is, "X and/or Y" is intended to mean X, Y or X and Y, for example. As a further example, "X, Y, and/or Z" is intended to mean X or Y or Z or any combination thereof. Also, the expression of A, B and C means various combinations including A; B; C; A and B; A and C; B and C; or A, B and C.

The following description is not intended to limit or define any claimed or as yet unclaimed subject matter. Subject matter that may be claimed may reside in any combination or sub-combination of the elements or process steps disclosed in any part of this document including its claims and figures. Accordingly, it will be appreciated by a person skilled in the art that an apparatus, system or method disclosed in accordance with the teachings herein may embody any one or more of the features contained herein and that the features may be used in any particular combination or sub-combination that is physically feasible and realizable for its intended purpose.

Recently, there has been a growing interest in developing new excavator attachments, also referred to herein as excavator attachment assemblies, with hydraulic working tools. Specifically, there is growing interest in developing excavator attachment assemblies with hydraulic working tools that are solely mounted on an excavator attachment that offer improved holding strength and can easily and efficiently be removed and interchanged with other excavator bucket assemblies.

It should be understood that, herein, the term "excavator attachment assembly" is intended to include assemblies that can be removably coupled to a boom of an excavator and generally include an attachment, such as but not limited to a bucket or a rake or the like, together with a working tool, such as a thumb, or one or more arms or a jaw bone. A grapple may also be considered excavator attachment assembly, where the attachment and the working tool may be similar in structure.

Figure 3:
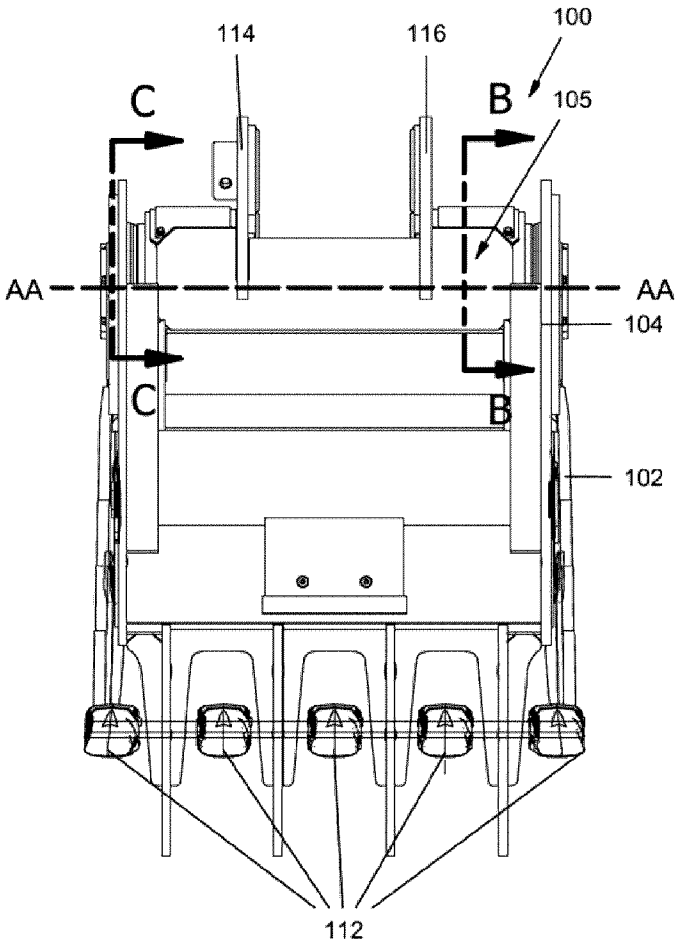
FIG. 3 is a front view of the excavator attachment assembly of FIG. 1 showing the working tool in the closed position.
Figure 2:
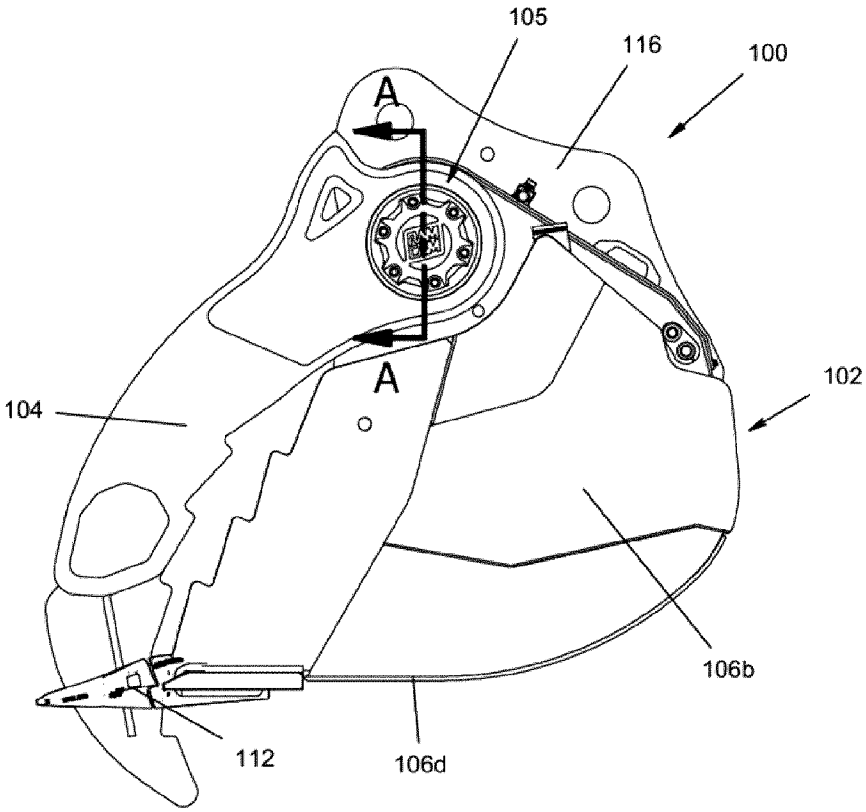
FIG. 2 is a side view of the excavator attachment assembly of FIG. 1 showing the working tool in a closed position.

Turning to the figures, FIG. 1 is a front perspective view from above of an excavator attachment assembly 100 according to at least one embodiment described herein. Excavator attachment assembly 100 includes a bucket 102 and a working tool 104 rotationally coupled to the bucket 102 by at least one coupling assembly 105. In the embodiment shown in FIG. 1, excavator bucket assembly 100 includes two coupling assemblies, a first coupling assembly 105*a* at least partially positioned within housing 120*a* and a second coupling assembly 105*b* at least partially positioned within housing 120*b*. FIGS. 2 and 3 show side and front views, respectively, of the excavator bucket assembly 100.

Figure 4:
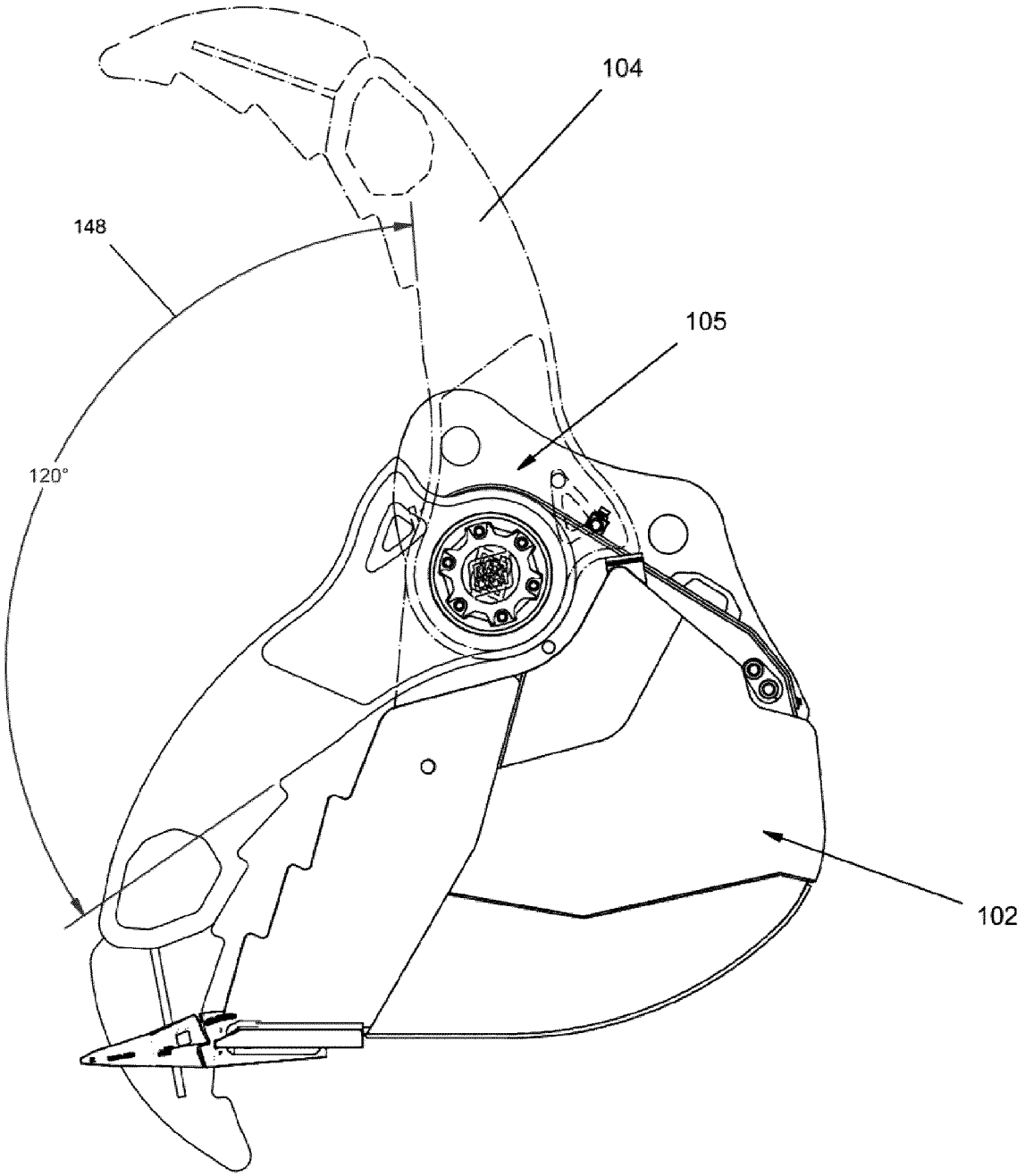
FIG. 4 is a side view of the excavator attachment assembly of FIG. 1 showing movement of the working tool between the closed position (shown in solid likes) and an open position (shown in broken lines).

Working tool 104 of excavator bucket assembly 100 is configured to rotate between a closed position, where working tool 104 may help secure contents in a cavity 108 of bucket 102 by substantially covering cavity 108 (see FIGS. 1-3), and an open position where working tool 104 is pivoted upwardly relative to cavity 108 of bucket 102 about an axis AA of drive shaft 126, described in greater detail below. FIG. 4 shows movement of working tool 104 of excavator bucket assembly 100 between its open position (shown in stippled lines) and its closed position (shown in solid lines). In at least one embodiment, working tool 104 has a full range of motion pivoting or rotating upwardly about the axis AA of about 120 degrees while moving between its closed position and its open position.

Referring again to FIG. 1, bucket 102 includes a first side wall 106*a* and a second side wall 106*b* spaced apart from each other. Top wall 106*c* is coupled to and extends between first side wall 106*a* and second side wall 106*b* across an upper portion of bucket 102. Top wall 106*c* also acts to support at least some of the components of coupling assembly 105. Top wall 106*c* is also coupled to a rear wall 106*d* at a rear portion of bucket 102. Rear wall 106*d* couples to first side wall 106*a* and second side wall 106*b* and extends across rear and lower portions of bucket 102. Generally, rear wall 106*d* is curved upwardly at a rear portion of bucket 102 to meet top wall 106*c*. In some embodiments, top wall 106*c* and rear wall 106*d* may be integral with each other. Rear wall 106*d* defines a lower edge 110 of bucket 102 and one or more teeth 112 may be coupled to rear wall 106*d* adjacent to lower edge 110 to form a cutting edge of bucket 102. First side wall 106*a*, second side wall 106*b*, top wall 106*c* and rear wall 106*d* co-operate to define cavity 108 of bucket 102.

Bucket 102 includes an excavator coupler 107 for coupling the bucket assembly 100 to an arm of an excavator. In the embodiment shown in the drawings, excavator coupler 107 comprises a first coupling flange 114 and a second coupling flange 116. First coupling flange 114 and second coupling flange 116 are each mounted to top wall 106*c* of bucket 102. First coupling flange 114 and second coupling flange 116 are laterally spaced apart from each other across a width of bucket 102. First coupling flange 114 and second coupling flange 116 are specifically positioned between first side wall 106*a* and second side wall 106*b*. First coupling flange 114 and second coupling flange 116 are configured to receive at least a portion of an arm of an excavator, or conversely at least a portion of a coupler coupled to an arm of an excavator, to releasably couple the bucket assembly 100 to the excavator.

Figure 5:
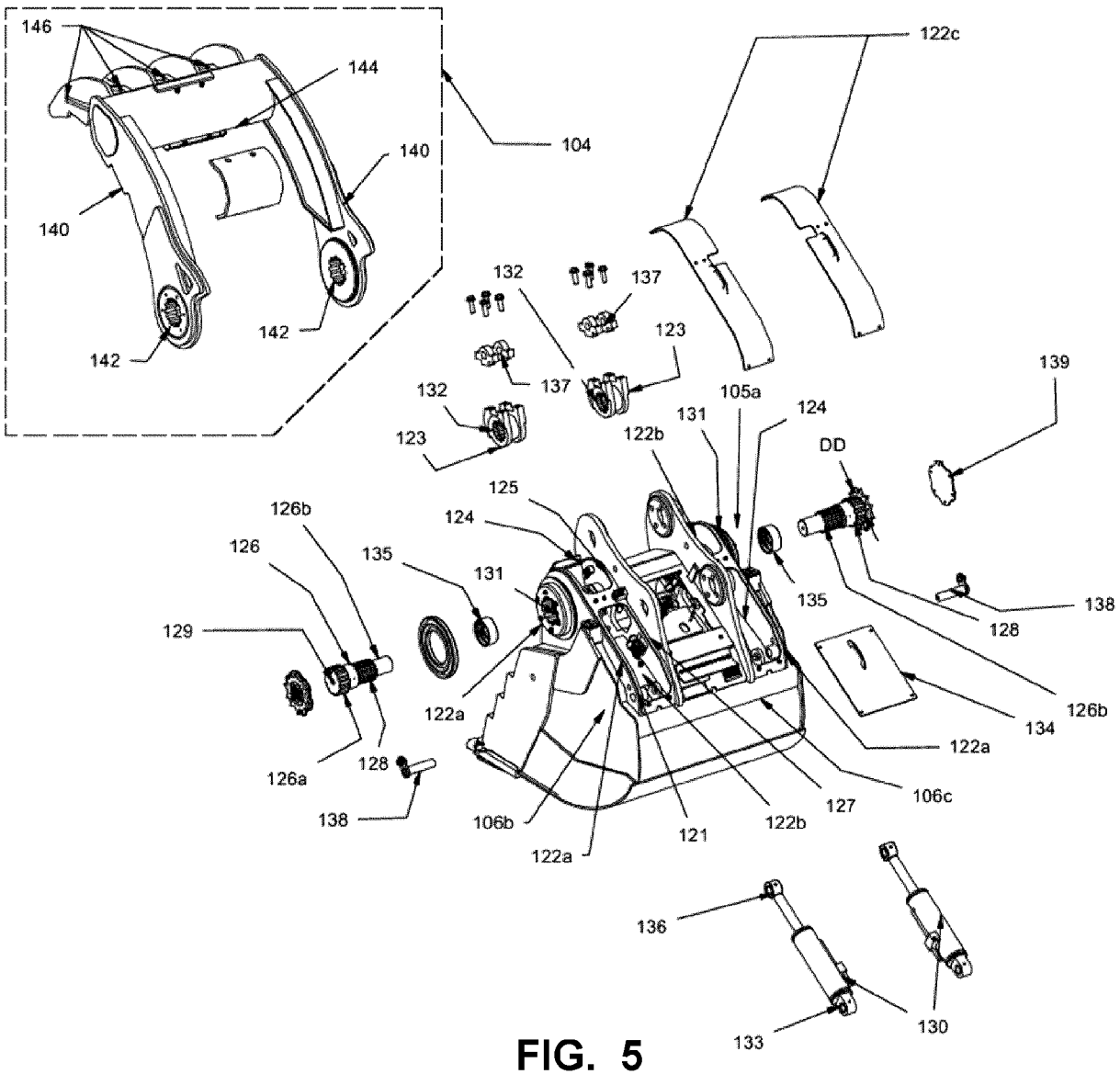
FIG. 5 is an exploded perspective view from behind of the excavator attachment assembly with a working tool of FIG. 1 showing the working tool in the open position.

Turning now to FIG. 5, shown therein is a rear exploded perspective view from behind of the excavator bucket assembly 100. In the exploded perspective view, working tool 104 is shown in its open position. As noted above, excavator bucket assembly 100 includes at least one coupling assembly 105 including a plurality of components configured to rotatably couple working tool 104 to bucket. One or more of the components of coupling assembly 105 is fixed to top wall 106*c* of bucket 102 for rotatably coupling the working tool 104 to the bucket 102. In the embodiment show in the figures, bucket assembly 100 includes a pair of coupling assemblies for coupling the working tool 104 to the bucket 102, a first coupling assembly 105*a* and a second coupling assembly 105*b*.

First coupling assembly 105*a* and second coupling assembly 105*b* are spaced apart from each other laterally across a width of the bucket 102. In some cases bucket assembly 100 may include one coupling assembly 105 mounted to top wall 106*c* and positioned beside either first coupling flange 114 or second coupling flange 116 (e.g., either between first coupling flange 114 and first side wall 106*a* or between second coupling flange 116 and second sidewall 106*b*). By being positioned on a side of bucket 102, whereas in other embodiments such as but not limited to the embodiment shown in the figures, bucket assembly 100 may include two coupling assemblies 105*a*, 105*b*, coupled to top wall 106*c*.

In the embodiment shown in the figures, first coupling assembly 105*a* and second coupling assembly 105*b* are each shown fixed to top wall 106*c* of bucket 102. First coupling assembly 105*a* and second coupling assembly 105*b* may each include a respective housing 120*a*, 120*b* (see FIG. 1) configured to protect at least one of the components of its respective coupling assembly 105*a*, 105*b*. For example, each of the first coupling assembly 105*a* and second coupling assembly 105*b* include a respective linear actuator 130 (described in greater detail below). Each housing 120*a*, 120*b* may be configured to house a respective linear actuator 130 to protect it from physical damage.

In the embodiment shown in the drawings, each housing 120 is defined by an outside flange 122*a* and an inside flange 122*b*, each extending upwardly from the top wall 106*c* of bucket 102. Outside flange 122*a* extends upwardly to a top edge 121 and inside flange 122*b* extends upwardly to a top edge 127. Housing 120 also includes a cover 122*c* configured to connect to each of outside flange 122*a* and inside flange 122*b* to co-operate with the outside flange 122*a* and an inside flange 122*b* to define a compartment 124 underneath housing 120. In at least one embodiment, each of outside flange 122*a* and inside flange 122*b* has a length that is greater than a length of linear actuator 130 and a width that is greater than a width of linear actuator 130 to provide for linear actuator 130 to be completely contained, or nested, within compartment 124. FIG. 5 also shows an optional intermediate cover 134 that can be positioned between the coupling flanges 114 and 116 to further cover and protect additional components of the coupling assemblies that may be positioned therein.

Each housing 120 is positioned laterally outwardly relative to excavator coupling flanges 114 and/or 116 (i.e., nearer to a side wall of bucket 102) to not inhibit the arm of the excavator, or a coupler coupled to the arm of the excavator, from engaging the coupling flanges 114, 116.

Figure 6B:
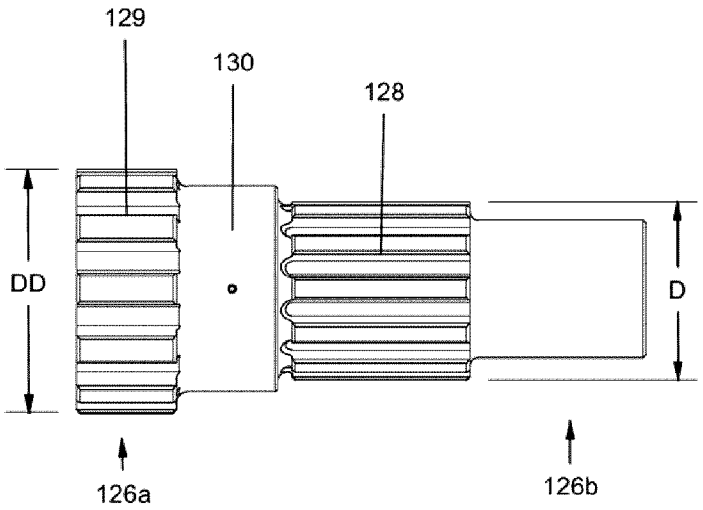
FIG. 6B is a side view of the drive shaft of FIG. 6A.
Figure 6A:
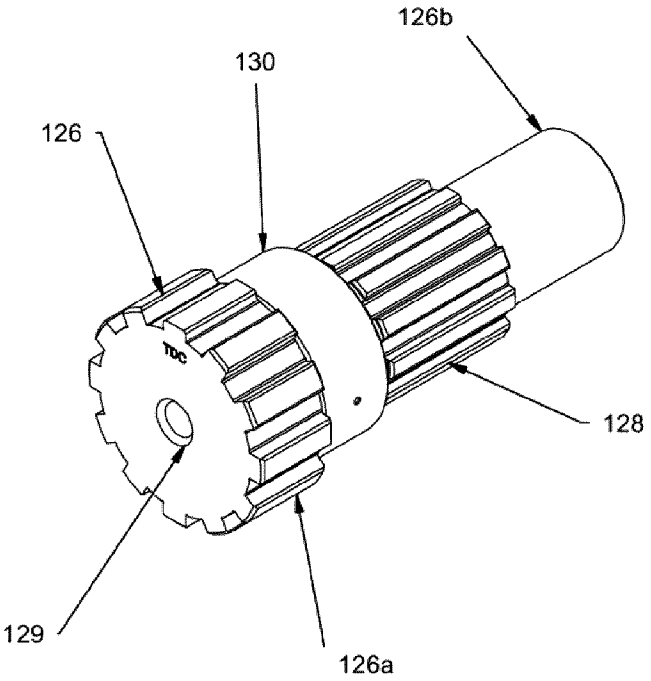
FIG. 6A is a perspective view of a drive shaft of the excavator attachment assembly of FIG. 1

Each coupling assembly 105*a* and 105*b* also includes a drive shaft 126 extending laterally between the outside flange 122*a* and inside flange 122*b* at a position spaced upwardly from top wall 106*c* of bucket 102. FIG. 6A shows a perspective view of a drive shaft 126 and FIG. 6B shows a side view of a drive shaft 126, according to at least one embodiment described herein.

Drive shaft 126 has an outside end 126*a* and an inside end 126*b*. When drive shaft 126 is positioned on bucket assembly 100, at least a portion of outside end 126*a* extends outwardly from outside flange 122*a* to couple with an arm 140 of the working tool 104. Inside end 126*b* is configured to couple to (e.g., be retained or secured by) inside flange 122*b*. For example, in the embodiment shown in the figures, inside end 126*b* is configured to be received in an aperture 125 of inside flange 122*b*. Inside end 126*b* is shaped to be rotatably received inside aperture 125 of inside flange 122*b*.

In at least one embodiment, at least a portion of drive shaft 126 is splined. The splines of each drive shaft 126 are ridges or teeth that mesh with grooves in a mating piece and transfer torque to the mating piece, thereby maintaining an angular correspondence between the splined drive shaft 126 and the respective mating piece. In the embodiment shown in the drawings, each drive shaft 126 includes two splined portions, an inside splined portion 128 adjacent to inside end 126*b* and an outside splined portion 129 positioned at outside end 126*a* of drive shaft 126. Drive shaft 126 is configured so inside splined portion 128 is positioned between outside flange 122*a* and inside flange 122*b* to couple with a cylinder lug 123 therein (described in greater detail below). Each drive shaft 126 is also configured so outside splined portion 129 is positioned outwardly (i.e., laterally away from the coupling flanges of bucket 102) from both outside flange 122*a* and inside flange 122*b* along an axis of drive shaft 126 and is configured to couple with a connecting arm 140 of working tool 104.

In the embodiment shown in the figures, between inside splined portion 128 and outside splined portion 129 is a spacer portion 130. Spacer portion 130 has a smooth outside surface and is sized and shaped to be received in an aperture 131 of outside flange 122*a* to support the drive shaft 126 therein. A bushing 135 may also be included within aperture 131 to promote rotation of spacer portion 130 (and drive shaft 126) relative to outside flange 122*a*.

In at least one embodiment, inside splined portion 128 and outside splined portion 129 may have differing diameters. For example, inside splined portion 128 may have a diameter D that is smaller than a diameter of aperture 131 of outside flange 122*b* to provide for inside splined portion 128 to be inserted through aperture 131 and positioned between outside flange 122*a* and inside flange 122*b*. Second splined portion 129 has a diameter DD that is greater than the diameter of the aperture 131 to provide for second splined portion 129 to remain outward of outside flange 122*a* to couple with connecting arm 140 of working tool 104. A cover 139 may also be provided to cover outside end 126*a* of drive shaft 126.

Figure 7:
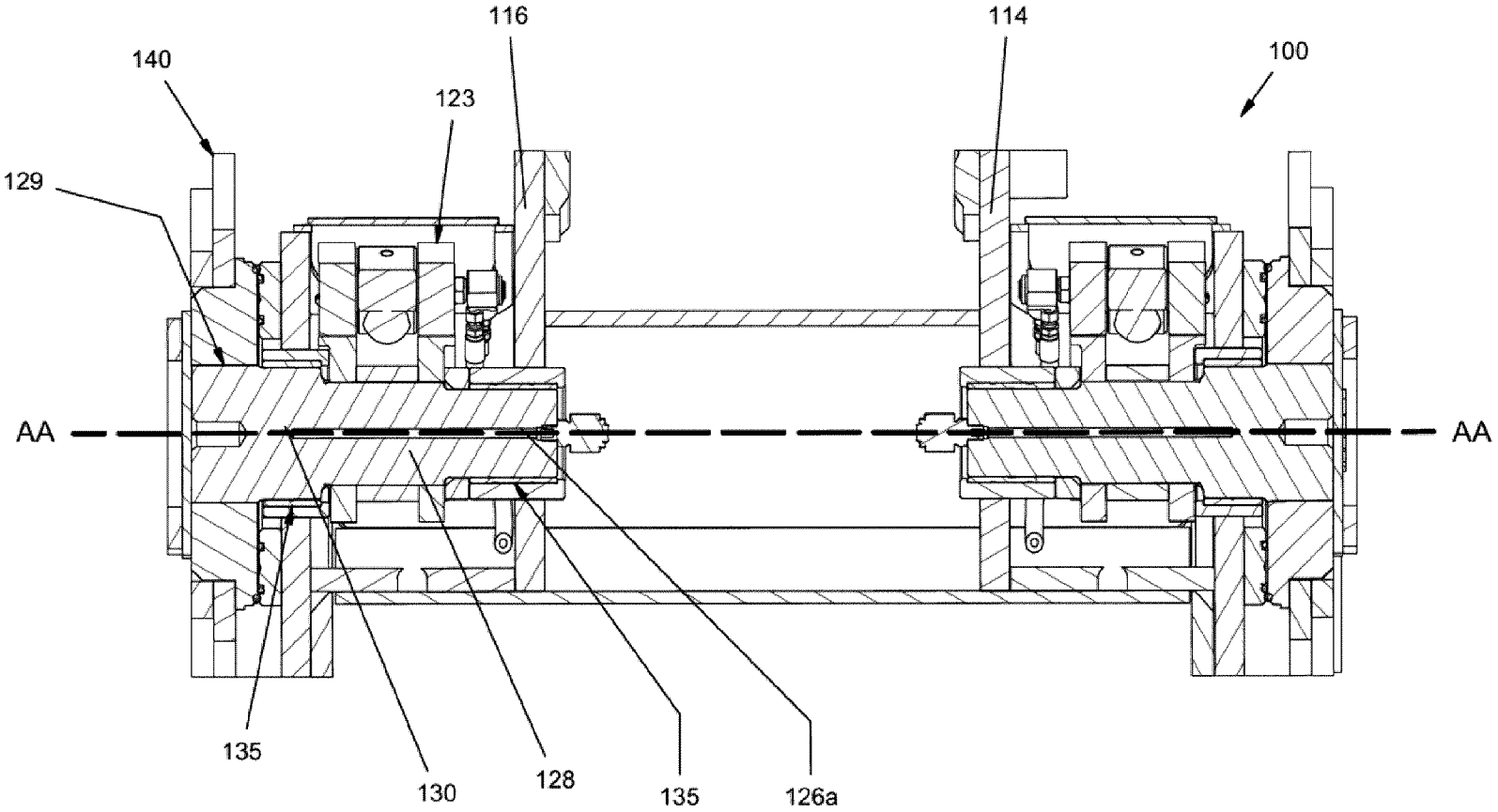
FIG. 7 is cross-sectional view of a top portion of the excavator attachment assembly of FIG. 1 through the drive shaft along the axis A-A shown in FIG. 2.

FIG. 7 is cross-sectional view of bucket assembly 100 thorough drive shaft 126 along the axis A-A shown in FIG. 2. FIG. 7 shows that one or more bushings 135 may be positioned between, for example, inside end 126*b* and aperture 125 of inside flange 122*b*, and/or between spacer portion 130 and aperture 131 of outside flange 122*a*.

Each coupling assembly 105*a* and 105*b* also includes a cylinder lug 123. Cylinder lug 123 is configured to be receive and depend from the drive shaft 126 and be pivotally coupled to the linear actuator 130. Cylinder lug 123 includes a mating portion 132 that includes an aperture leading to a cavity within the mating portion 132, the cavity having grooves on an inner surface therefore that are configured to mesh with splines of the inside splined portion 128 of drive shaft 126. Cylinder lug 123 also includes a two flanges 137 configured to pivotally couple to linear actuator 130. Specifically, each flange 137 has an aperture defining a cavity therein to receive a pin to pivotally couple to second end 136 of linear actuator 130. In the embodiment shown in the drawings, each flange 137 is removably coupled to mating portion 132 (for example, by one or more fasteners as shown in FIG. 5). Each flange 137 being removably coupled to mating portion 132 may provide for easily removing the linear actuator 130, or a part therefore, for example in the event of damage or failure of part or all of the linear actuator 130. After removing the fasteners coupling each flange 137 to mating portion 132, each flange 137 can slide off of an end of the pin passing through each flange 137 and second end 136 of linear actuator 130. Once each flange 137 has been removed, second end 136 of linear actuator 130 can be removed from compartment 124.

Each coupling assembly 105*a* and 105*b* also includes a linear actuator 130 (e.g., hydraulic cylinder). Linear actuator 130 can be any linear actuator capable of moving between an extended position and a retracted position. Linear actuator 130 can be any linear actuator appropriate for rotating working tool 104 about axis AA. For instance, linear actuator 130 may be a single acting hydraulic cylinder configured to pivot the working tool 104 about the axis AA in a single direction upon extension, or may be a double-acting hydraulic cylinder configured to rotate the working tool 104 about the axis AA in two directions upon extension and retraction. For example, in at least one embodiment, linear actuator 130 may be a hydraulic actuator hydraulically coupled to the excavator and configured to moving between an extended position, where the working tool 104 is in its closed position, and a retracted position, where the working tool 104 is in its open position.

Figure 8:
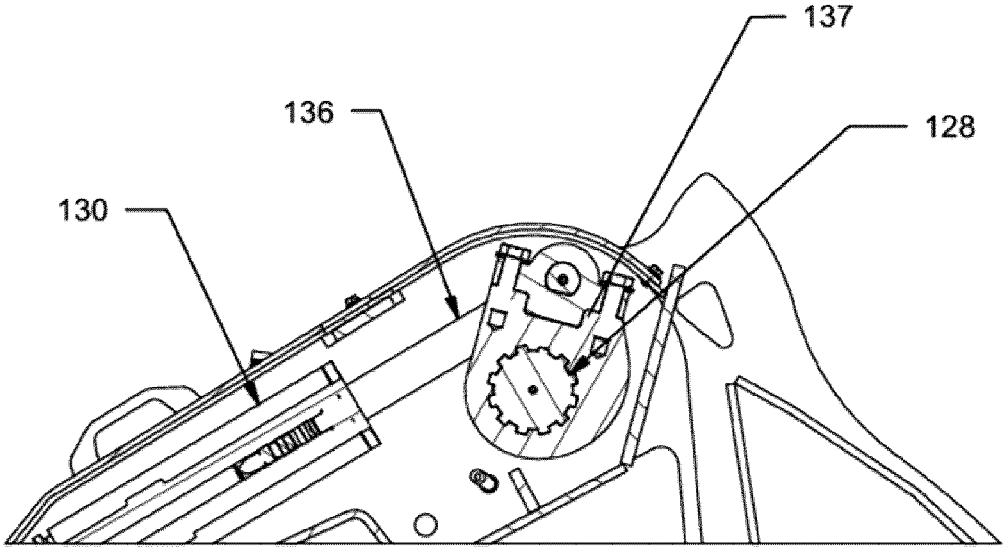
FIG. 8 is cross-sectional view of another portion of the excavator attachment assembly of FIG. 1 along the axis B-B shown in FIG. 3 showing the drive shaft.
Figure 9:
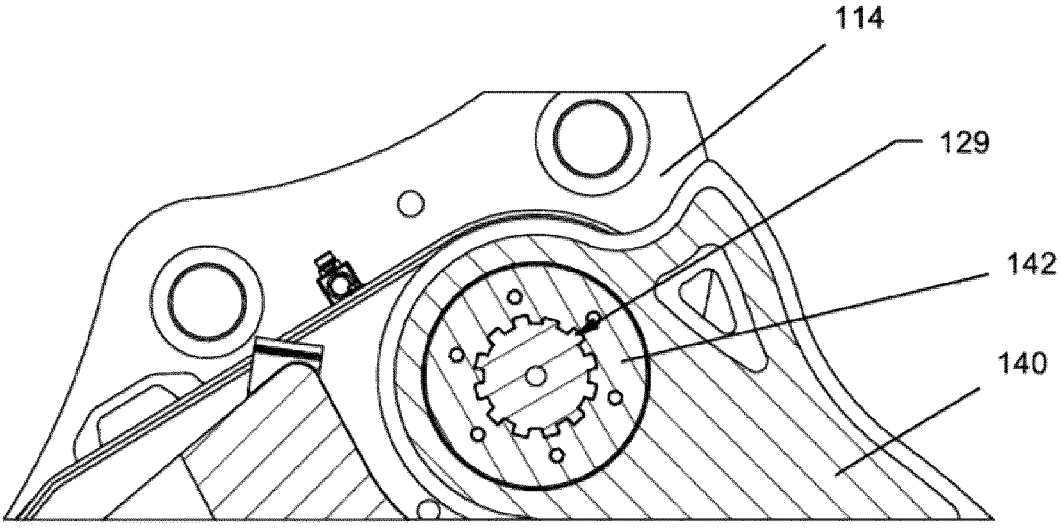
FIG. 9 is a cross-sectional view of another portion of the excavator attachment assembly of FIG. 1 along the axis C-C shown in FIG. 3.

Linear actuator 130 has a first end 133 pivotally mounted to top wall 106*c* rearward of drive shaft 126, such as but not limited to by cylinder pin 138. Linear actuator 130 has a second end 136 coupled the cylinder lug 123, specifically to each flange 137 of cylinder lug 123. FIG. 8 is a cross-sectional view of bucket assembly 100 through the drive shaft 126 along the axis B-B shown in FIG. 3. FIG. 8 shows the connectivity of the second end 136 of linear actuator 130 to each flange 137 of cylinder lug 123 and their respective position when linear actuator 130 is in its extended position and the working tool 104 is in its closed position. FIG. 9 is a cross-sectional view of the drive shaft 126 of the excavator bucket assembly 102 along the axis C-C shown in FIG. 3. FIG. 9 shows the connectivity of outside splined portion 129 of drive shaft 126 to one of the spaced apart connecting arms 140 of working tool 104 when linear actuator 130 is in its extended position and the working tool 104 is in its closed position.

As noted above, linear actuator 130 is configured to rotate drive shaft 126 and therefore the working tool 104 from it closed position to its open position by retracting towards its retracted position. Linear actuator 130 is configured to rotate drive shaft 126 and therefore the working tool 104 from its open position to its closed position by extending towards its extended position.

Working tool 104 includes a pair of spaced apart connecting arms 140. At least one of the connecting arms 140 is configured to couple with outside splined portion 129 extending laterally outwardly from outside flange 122*a*. Connecting arm 140 is coupled to outside splined portion 129 by a mating portion 142 (see FIG. 5) that includes an aperture having grooves on an inner surface therefore that are configured to mesh with splines of the second splined portion 129.

Working tool 104 may also include a thumb framework 144 and a plurality of claws 146. Claws 146 are spaced apart from each other by a distance to interdigitate with the teeth 112 of bucket 102.

In at least one embodiment, since the spaced apart connecting arms 140 of working tool 104 are spaced apart by a distance that is greater than a spacing between the first coupling flange 114 and second coupling flange 116, working tool 104 can rotate from the fully closed position of FIGS. 1-3 to an open position shown in dotted relief if FIG. 4. As working tool 104 rotates through arc 148 to its open position, arms 140 fully rotate possible until framework 144 contacts the stick of the excavator.

Figure 10:
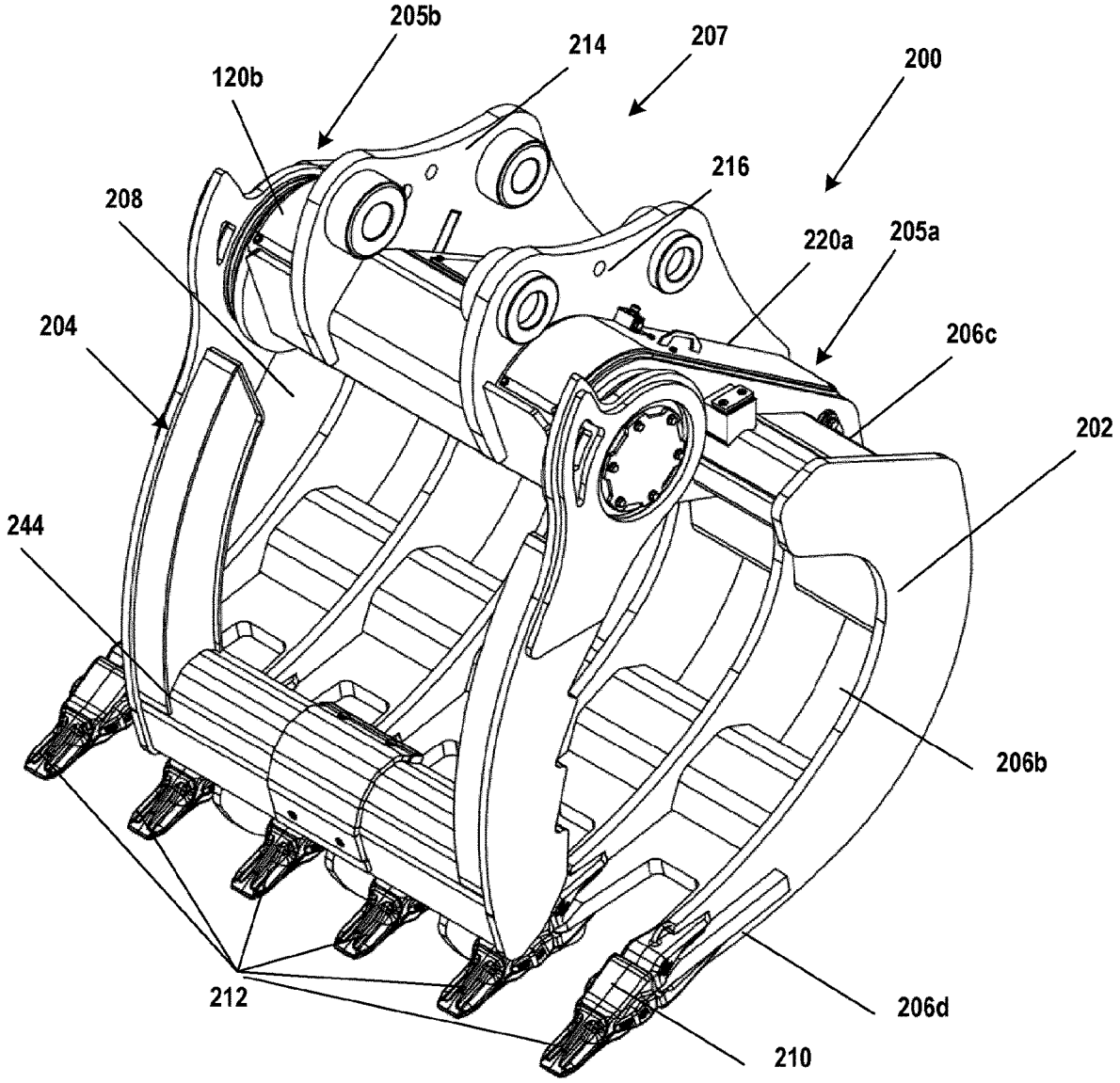
FIG. 10 is a front perspective view from above of an excavator attachment assembly having an excavator rake and a working tool coupled thereto, according to at least one embodiment described herein.
Figure 12:
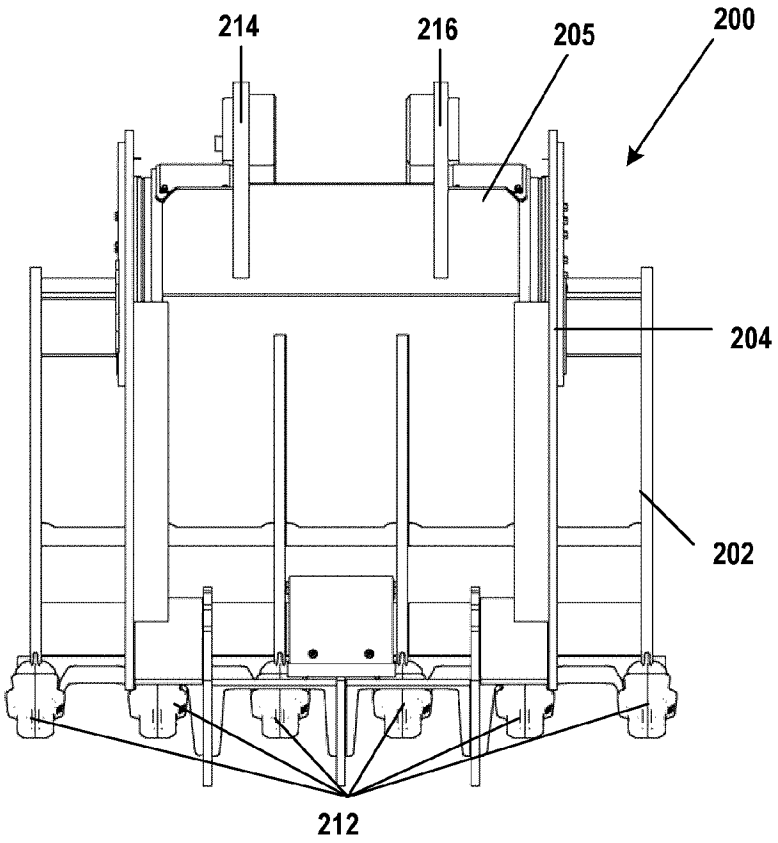
FIG. 12 is a front view of the excavator attachment assembly of FIG. 10 showing the working tool in the closed position.
Figure 11:
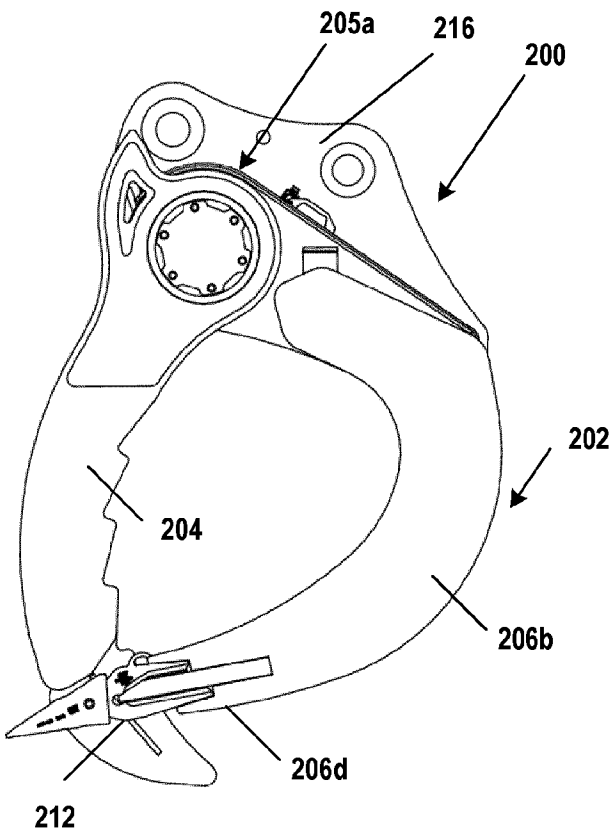
FIG. 11 is a side view of the excavator attachment assembly of FIG. 10 showing the working tool in a closed position.
Figure 13:
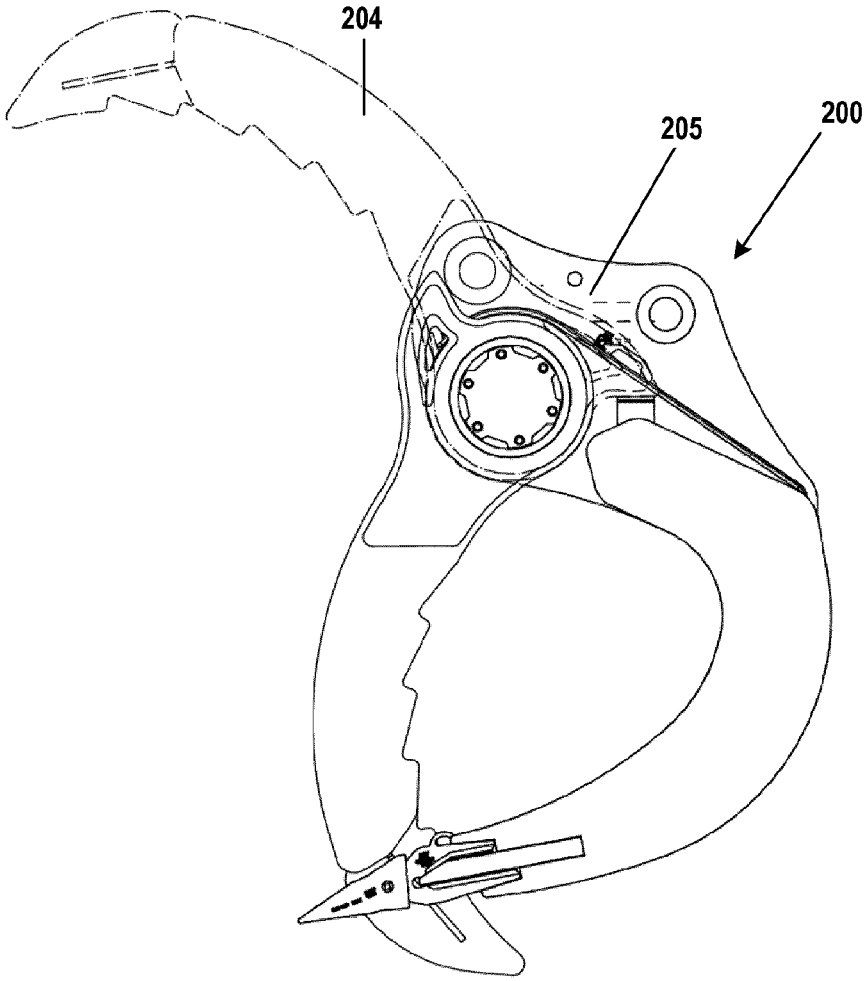
FIG. 13 is a side view of the excavator attachment assembly of FIG. 10 showing movement of the working tool between the closed position (shown in solid likes) and an open position (shown in broken lines).
Figure 14:
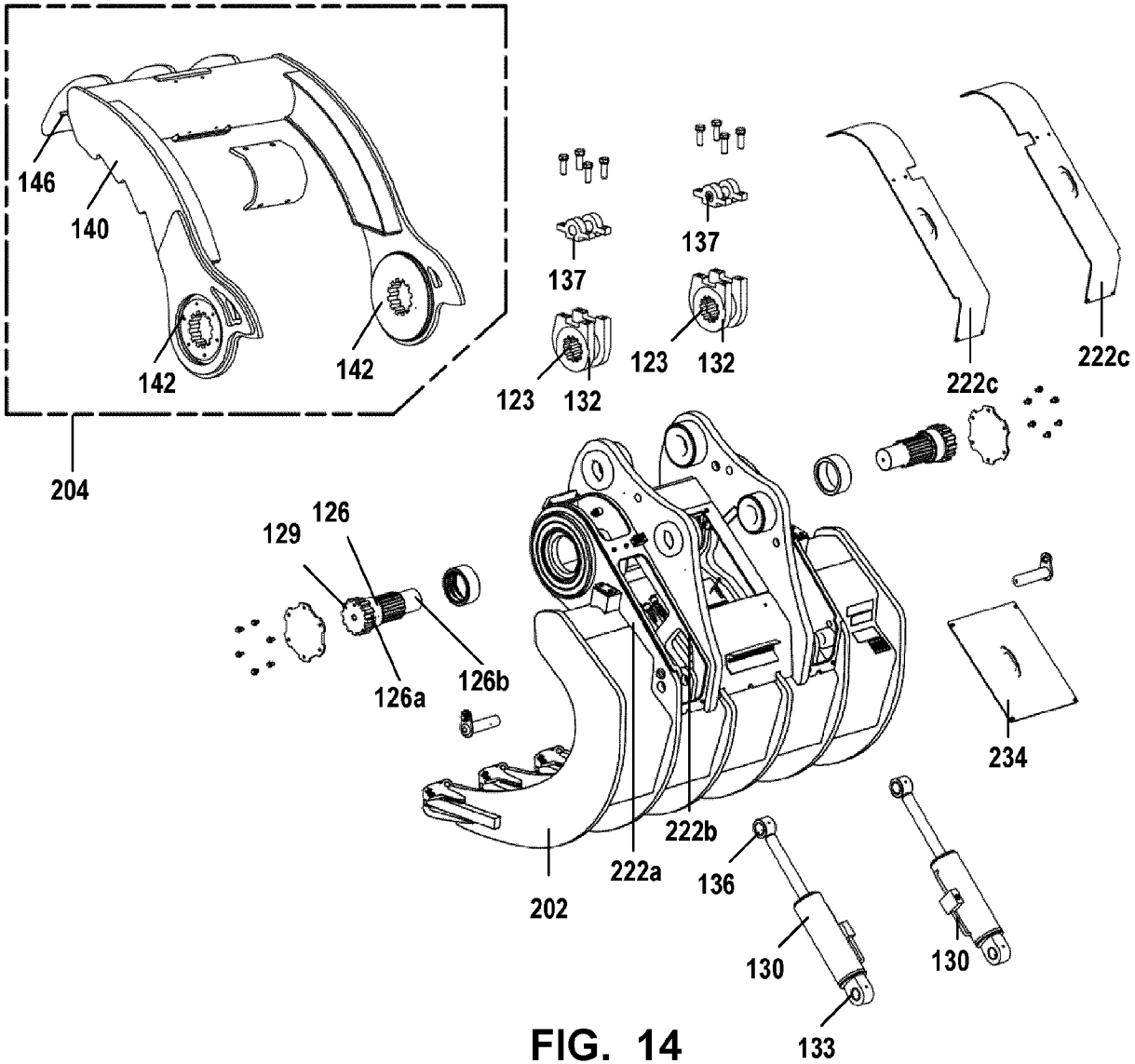
FIG. 14 is an exploded perspective view from behind of the excavator attachment assembly with a working tool of FIG. 10 showing the working tool in the open position.
Figure 15:
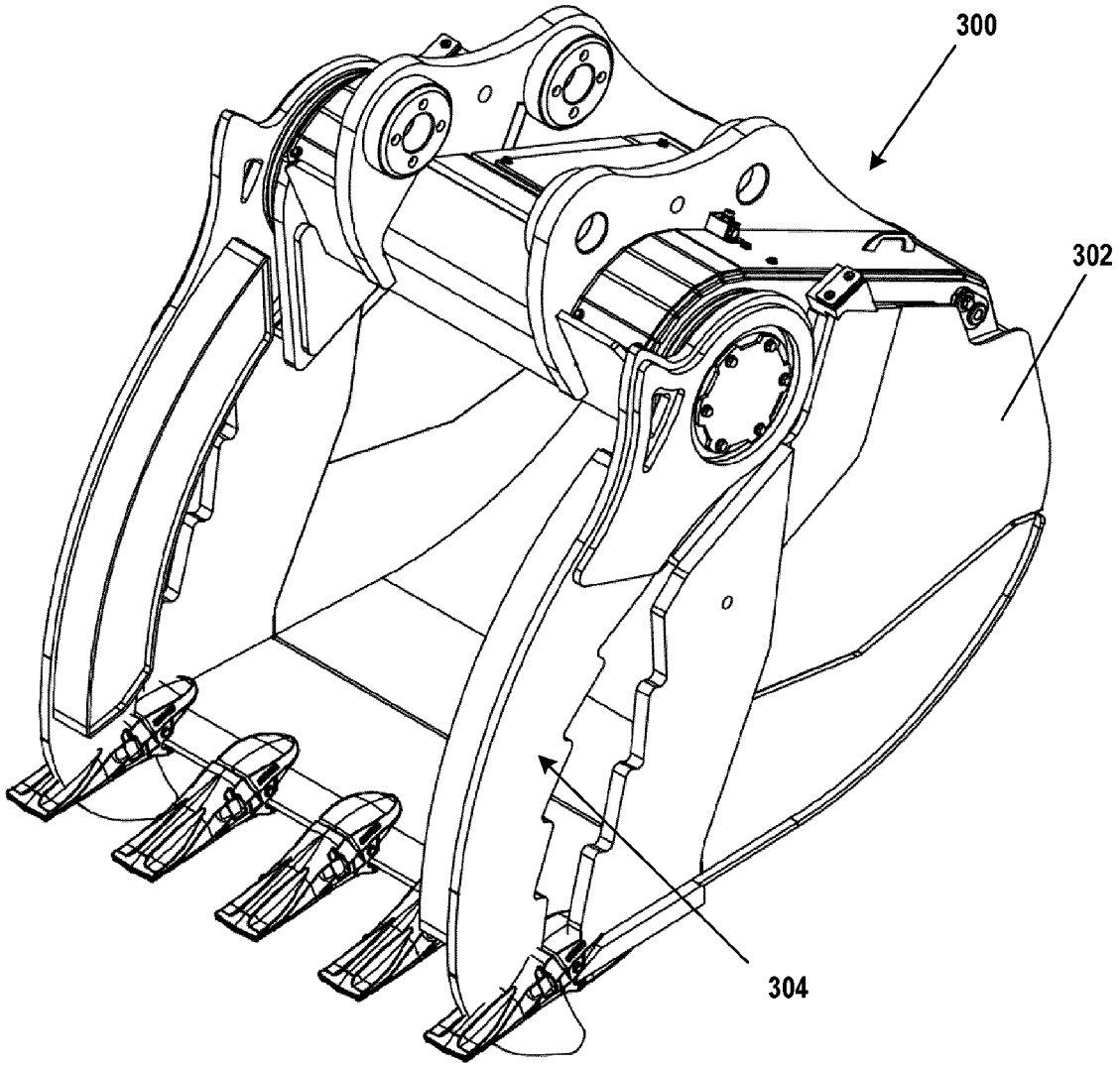
FIG. 15 is a front perspective view from above of another excavator attachment assembly having an excavator bucket and a working tool coupled thereto, according to at least one embodiment described herein.
Figure 17:
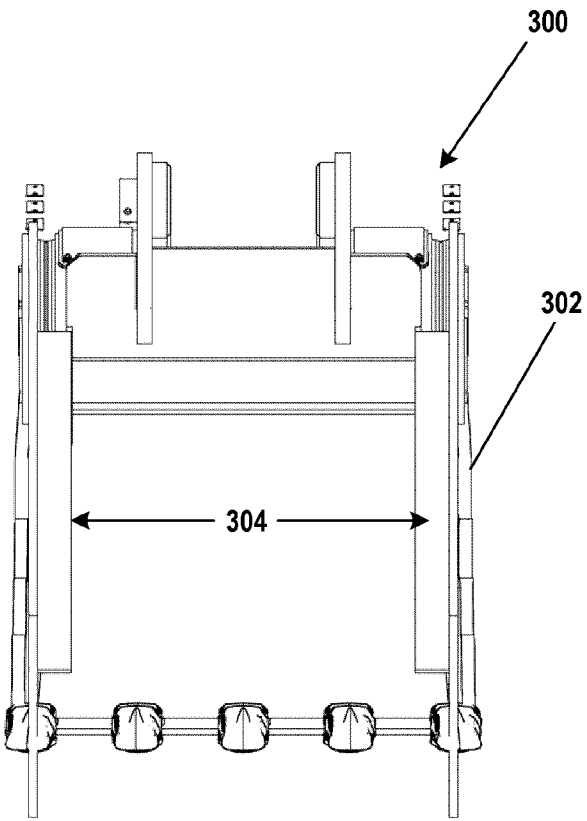
FIG. 17 is a front view of the excavator attachment assembly of FIG. 15 showing the working tool in the closed position.
Figure 16:
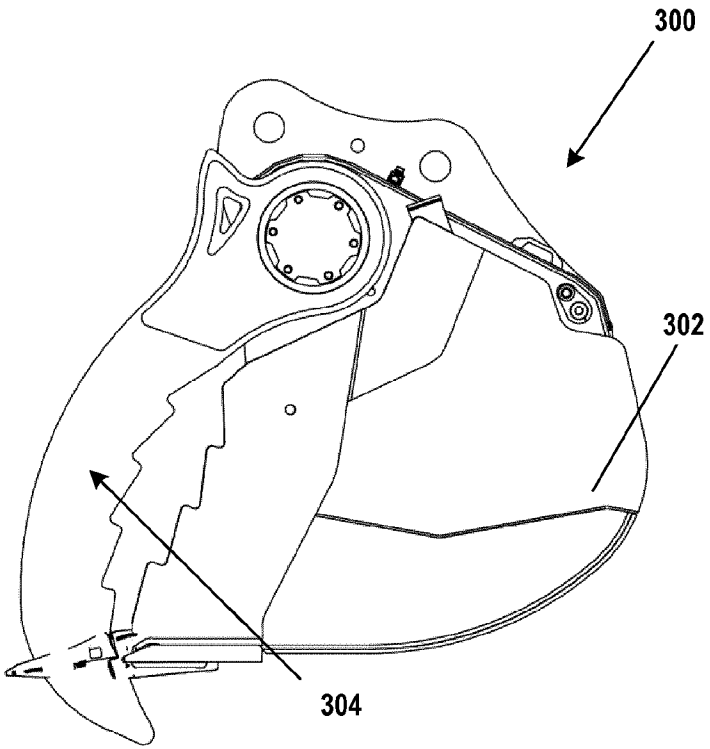
FIG. 16 is a side view of the excavator attachment assembly of FIG. 15 showing the working tool in a closed position.
Figure 18:
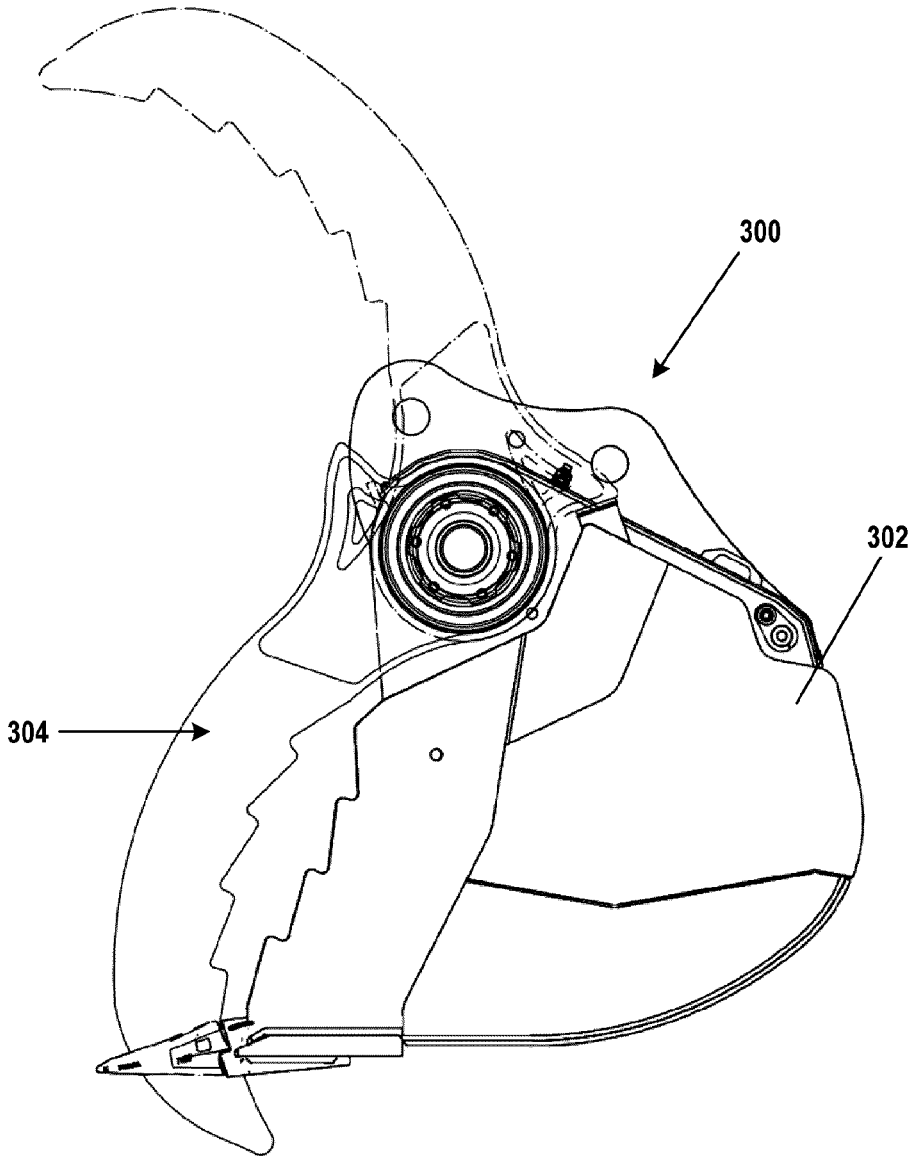
FIG. 18 is a side view of the excavator attachment assembly of FIG. 15 showing movement of the working tool between the closed position (shown in solid likes) and an open position (shown in broken lines).
Figure 19:
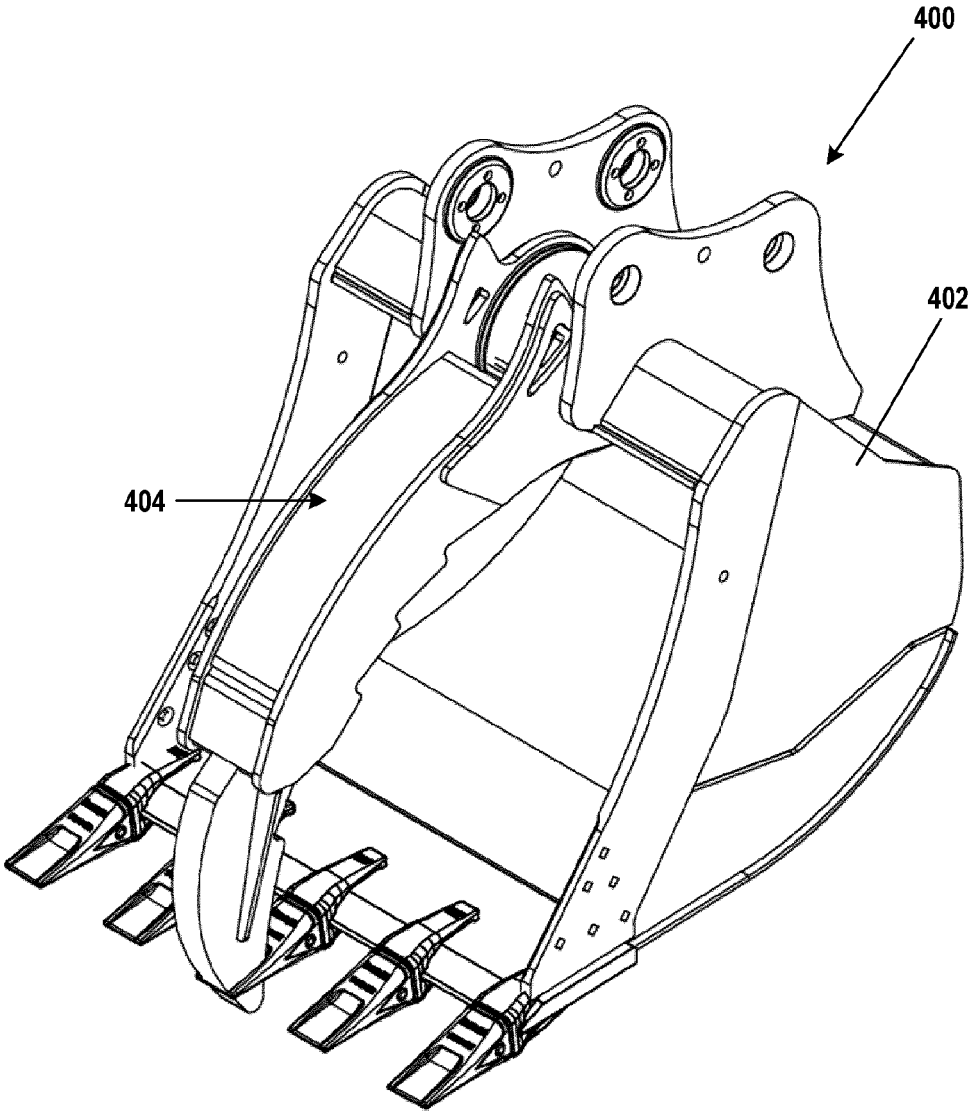
FIG. 19 is a front perspective view from above of another excavator attachment assembly having an excavator bucket and a working tool coupled thereto, according to at least one embodiment described herein.
Figure 21:
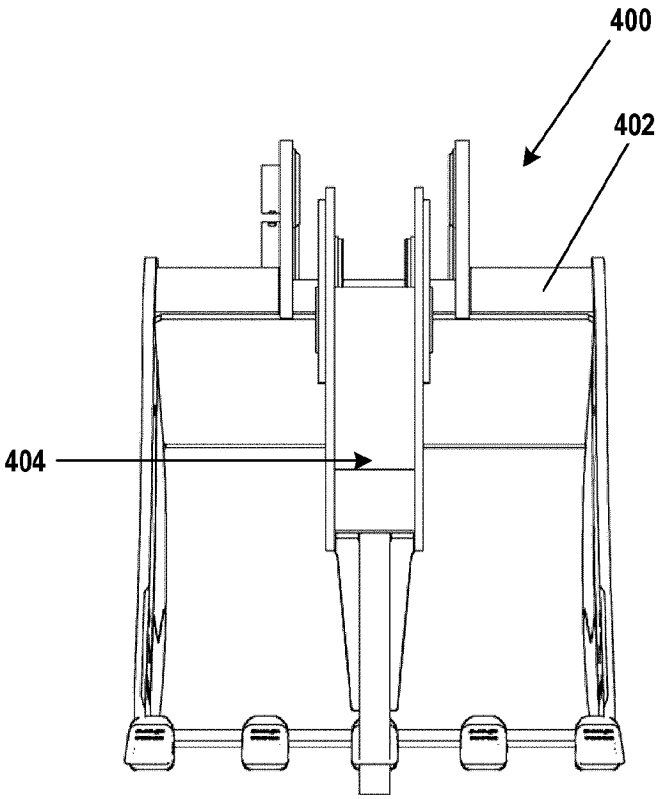
FIG. 21 is a front view of the excavator attachment assembly of FIG. 19 showing the working tool in the closed position.
Figure 20:
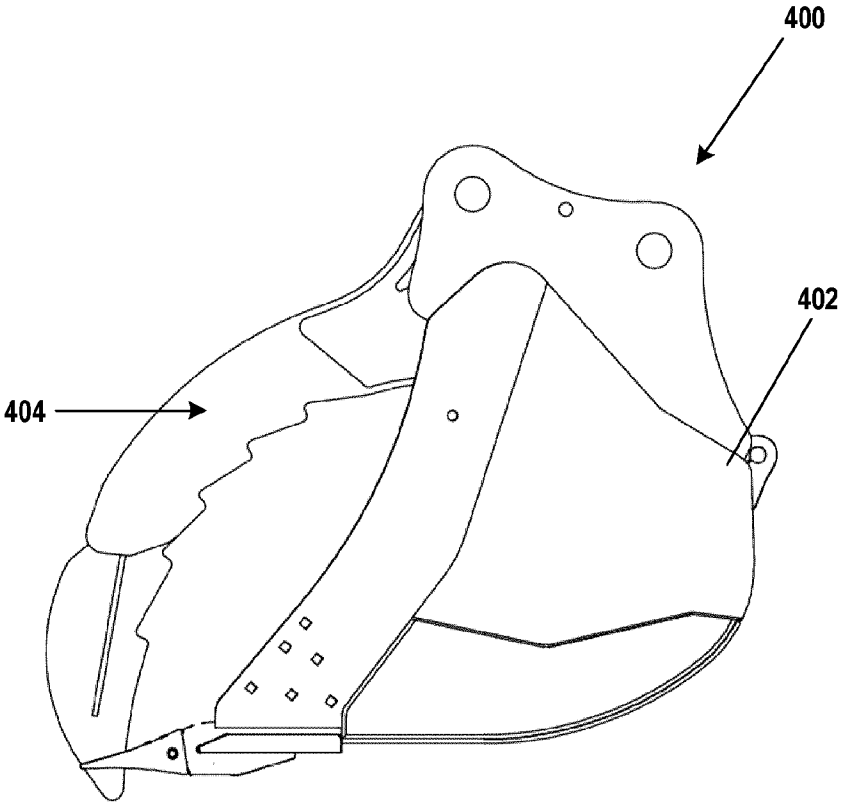
FIG. 20 is a side view of the excavator attachment assembly of FIG. 19 showing the working tool in a closed position.
Figure 22:
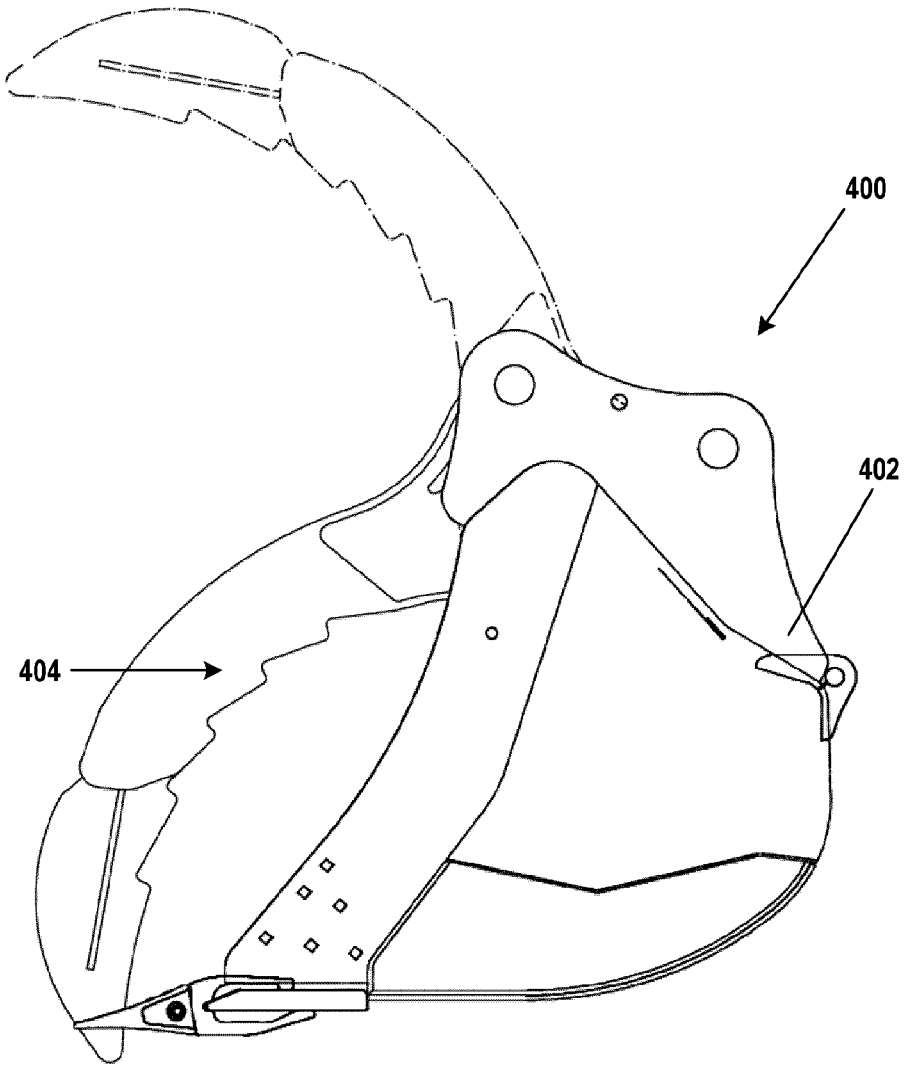
FIG. 22 is a side view of the excavator attachment assembly of FIG. 19 showing movement of the working tool between the closed position (shown in solid likes) and an open position (shown in broken lines).

Turning to FIGS. 10-14, shown therein is a second embodiment of an excavator attachment assembly 200 having a working tool. FIG. 10 is a rear perspective, exploded view from above of an excavator attachment assembly 200 according to at least one embodiment described herein. Elements of assembly 200 which correspond with assembly 100 are given the same reference numeral increased by 100. Excavator attachment assembly 200 includes a rake 202 and a working tool 204 rotationally coupled to the rake 202 by at least one coupling assembly 205. In the embodiment shown in FIG. 10, excavator attachment assembly 200 includes two coupling assemblies, a first coupling assembly 205*a* at least partially positioned within housing 220*a* and a second coupling assembly 205*b* at least partially positioned within housing 220*b*.

Working tool 204 of excavator attachment assembly 200 is configured to rotate between a closed position, where working tool 204 may help secure contents in a cavity 208 of rake 202 by substantially covering cavity 208, and an open position where working tool 204 is pivoted upwardly relative to cavity 208 of rake 202 about an axis of drive shaft 226. Like described above with respect to working tool 104, working tool 204 has a full range of motion pivoting or rotating upwardly about 120 degrees while moving between its closed position and its open position.

Rake 202 includes a first side wall 206*a* and a second side wall 206*b* spaced apart from each other. Top wall 206*c* is coupled to and extends between first side wall 206*a* and second side wall 206*b* across an upper portion of rake 202. Top wall 206*c* also acts to support at least some of the components of coupling assembly(ies) 205. Top wall 206*c* is either integral with or couples to a curved rear wall 206*d* at a rear portion of rake 202. Rear wall 206*d* is also coupled to first side wall 206*a* and second side wall 206*b* and forms rear and lower portions of rake 202.

Rear wall 206*d* defines a lower edge 210 of rake 202 and one or more teeth 212 may be coupled to rear wall 206*d* adjacent to lower edge 210 to form a cutting edge of rake 202. First side wall 206*a*, second side wall 206*b*, top wall 206*c* and rear wall 206*d* co-operate to define cavity 208 of rake 202.

Like bucket 102 described above, rake 202 includes a coupler 207 for coupling the attachment assembly 200 to an arm of an excavator.

Excavator attachment assembly 200 includes at least one coupling assembly 205 including a plurality of components configured to rotatably couple working tool 204 to rake 202. First coupling assembly 205*a* and second coupling assembly 205*b* are spaced apart from each other laterally across a width of rake 202. In some cases, attachment assembly 200 may include one coupling assembly 205 mounted to top wall 206*c* and positioned beside either first coupling flange 214 or second coupling flange 216 (e.g., either between first coupling flange 214 and first side wall 206*a* or between second coupling flange 216 and second sidewall 206*b*). In other embodiments, attachment assembly 200 may include two coupling assemblies 205*a*, 205*b*, coupled to top wall 206*c*.

In the embodiment shown in the FIGS. 10 to 15, first coupling assembly 205*a* and second coupling assembly 205*b* are each shown fixed to top wall 206*c* of rake 202. First coupling assembly 205*a* and second coupling assembly 205*b* may each include a respective housing 220*a*, 220*b* (see FIG. 10) configured to protect at least one of the components of its respective coupling assembly 205*a*, 205*b*. For example, each of the first coupling assembly 205*a* and second coupling assembly 205*b* include a respective linear actuator 230 (described in greater detail below). Each housing 220*a*, 220*b* may be configured to house a respective linear actuator 230 to protect it from physical damage.

In the embodiment shown in the drawings, each housing 220 is defined by an outside flange 222*a* and an inside flange 222*b*, each extending upwardly from the top wall 206*c* of rake 202. Outside flange 222*a* extends upwardly to a top edge 221 and inside flange 222*b* extends upwardly to a top edge 227. Housing 220 also includes a cover 222*c* configured to connect to each of outside flange 222*a* and inside flange 222*b* to co-operate with the outside flange 222*a* and an inside flange 222*b* to define a compartment 224 underneath housing 220. In at least one embodiment, each of outside flange 222*a* and inside flange 222*b* has a length that is greater than a length of linear actuator 230 and a width that is greater than a width of linear actuator 230 to provide for linear actuator 230 to be completely contained, or nested, within compartment 224. FIG. 5 also shows an optional intermediate cover 234 that can be positioned between the coupling flanges 214 and 216 to further cover and protect additional components of the coupling assemblies that may be positioned therein.

Each housing 220 is positioned laterally outwardly relative to excavator coupling flanges 214 and/or 216 (i.e., nearer to a side wall of rake 202) to not inhibit the arm of the excavator, or a coupler coupled to the arm of the excavator, from engaging the coupling flanges 214, 216.

It should be understood that the working tool of the attachment assemblies described herein should not be limited to being a thumb, as described with reference to the embodiments shown in FIGS. 1-9 and 10-14, respectively. For example, the working tool may be a jaw bone, a single working arm that may be positioned at a side of the coupling member or in a middle of a width of the attachment, or two or more arms that are operationally dependent or operationally independent.

One example of one of these embodiments is shown in FIGS. 15-18, where shown therein is another embodiment of an excavator attachment assembly 300 having an attachment 302 (i.e., a bucket) and two independently operating arms as working tool 304. The independently operating arms are individually controlled to be raised and lowered between their open and closed positions.

Another example is shown in FIGS. 19-22. Therein excavator attachment assembly 400 has an attachment 402 (i.e., a bucket) and a single working arm as working tool 404. The coupling assembly of the attachment is fixed to the top wall between portions of the excavator coupler of the working tool.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. An excavator attachment assembly comprising:

an attachment comprising first and second side walls spaced apart from each other, a top wall coupled to the first and second side walls and a rear wall coupled to the first and second side walls, the first and second sides walls, the top wall and the rear wall defining a cavity of the attachment;

an excavator coupler extending upwardly from the top wall of the attachment for coupling the attachment to an arm of an excavator; and a working tool having at least one connecting arm;

wherein the attachment comprises at least one coupling assembly fixed to the top wall of the attachment for coupling the working tool to the attachment, the coupling assembly comprising:

an outside flange and an inside flange spaced apart from each other, each flange extending upwardly from the top wall of the attachment;

a drive shaft extending laterally between the outside flange and the inside flange, the drive shaft being configured to rotate relative to the outside and inside flanges;

a cylinder lug fixedly coupled to the drive shaft in a space between the outside flange and the inside flange; and a linear actuator positioned between the inside flange and the outside flange, below a top edge of the inside flange and below a top edge of the outside flange, the linear actuator having a first end mounted to the top wall and a second end coupled to the cylinder lug, the linear actuator being configured to rotate the drive shaft upon being actuated between a retracted position and an extended position; and wherein the connecting arm of the working tool is coupled to an outside end of the drive shaft, whereby the working tool rotates between an open position and a closed position upon rotation of the drive shaft.

2. The excavator attachment assembly of claim 1, wherein the drive shaft includes an inside splined portion and the cylinder lug is coupled to the drive shaft at the inside splined portion.

3. The excavator attachment assembly of claim 2, wherein the inside splined portion is positioned between the inside flange and the outside flange.

4. The excavator attachment assembly of claim 2, wherein the inside splined portion has a diameter that is less than a diameter of an aperture of the outside flange to be inserted through the outside flange.

5. The excavator attachment assembly of claim 2, wherein the cylinder lug comprises a mating portion configured to mate with the inside splined portion to receive a torque from the linear actuator and rotate the drive shaft.

6. The excavator attachment assembly of claim 3, wherein the drive shaft includes an outside splined portion and the connecting arm is coupled to the drive shaft at the outside splined portion.

7. The excavator attachment assembly of claim 6, wherein the outside splined portion extends outwardly from the outside coupling flange.

8. The excavator attachment assembly of claim 6, wherein the outside splined portion has a diameter that is greater than a diameter of an aperture of the outside coupling flange to inhibit the outside splined portion from being inserted through the outside coupling flange.

9. The excavator attachment assembly of claim 6, wherein the inside splined portion has a first diameter and the outside splined portion has a second diameter, the first diameter and the second diameter being different.

10. The excavator attachment assembly of claim 9, wherein the first diameter is less than the second diameter.

11. The excavator attachment assembly of claim 1, wherein the coupling assembly further comprises a lid, the lid, the outside flange and the inside flange co-operating to form a housing of the excavator attachment assembly.

12. The excavator attachment assembly of claim 11, wherein the linear actuator is positioned within a compartment defined by the housing.

13. The excavator attachment assembly of claim 12, wherein the drive shaft is at least partially positioned within the compartment.

14. The excavator attachment assembly of claim 1, wherein the attachment is a bucket, a rake, a thumb or a jaw bone.

15. An excavator attachment assembly comprising:

an attachment comprising first and second side walls spaced apart from each other, a top wall coupled to the first and second side walls and a rear wall coupled to the first and second side walls, the first and second sides walls, the top wall and the rear wall defining a cavity of the attachment;

an excavator coupler extending upwardly from the top wall of the attachment for coupling the attachment to an arm of an excavator; and a working tool having two spaced apart connecting arms;

wherein the attachment comprises two coupling assemblies fixed to the top wall of the attachment, the two coupling assemblies being positioned on opposed sides of the excavator coupler for coupling the working tool to the attachment, each coupling assembly comprising:

an outside flange and an inside flange extending upwardly from the top wall of the attachment, the inside flange being spaced from the outside flange;

a drive shaft extending laterally between the outside flange and the inside flange, the drive shaft being configured to rotate relative to the outside and inside flanges;

a cylinder lug fixedly coupled to the drive shaft in a space between the outside flange and the inside flange; and a linear actuator positioned between the inside flange and the outside flange and below a top edge of the inside flange and below a top edge of the outside flange, the linear actuator having a first end mounted to the top wall and a second end coupled to the cylinder lug, the linear actuator being configured to rotate the drive shaft upon being actuated between a retracted position and an extended position;

wherein each connecting arm of the working tool is fixedly secured to an outside end of one of the drive shafts, whereby the working tool rotates between an open position and a closed position upon rotation of each of the drive shafts.

16. The excavator attachment assembly of claim 15, wherein each drive shaft includes an inside splined portion and the cylinder lug is coupled to the drive shaft at the inside splined portion.

17. The excavator attachment assembly of claim 16, wherein the inside splined portion is positioned between the inside flange and the outside flange.

18. The excavator attachment assembly of claim 16, wherein the inside splined portion has a diameter that is less than a diameter of an aperture of the outside flange to be inserted through the outside flange.

19. The excavator attachment assembly of claim 16, wherein the cylinder lug comprises a mating portion configured to mate with the inside splined portion to receive a torque from the linear actuator and rotate the drive shaft.

20. The excavator attachment assembly of claim 15, wherein, for each coupling assembly, the outside flange and the inside flange co-operate to form a housing of the excavator attachment assembly.

* * * * *